US007311422B1

(12) United States Patent
Chen

(10) Patent No.: US 7,311,422 B1
(45) Date of Patent: Dec. 25, 2007

(54) RECESSED LAMP STRUCTURE

(76) Inventor: Yen-Chang Chen, No. 4, Alley 10, Lane 1, Pao An Street, Sec. 3, Shu Lin, Taipei Hsien (TW)

( * ) Notice: Subject to any disclaimer, the term of this patent is extended or adjusted under 35 U.S.C. 154(b) by 0 days.

(21) Appl. No.: 11/482,742

(22) Filed: Jul. 10, 2006

(51) Int. Cl.
*F21V 15/00* (2006.01)

(52) U.S. Cl. ..... 362/364; 362/371; 362/269; 362/275; 362/287; 362/419; 362/427

(58) Field of Classification Search ..... 362/364, 362/365, 369, 370, 371, 393, 269, 275, 287, 362/419, 427
See application file for complete search history.

(56) References Cited

U.S. PATENT DOCUMENTS 5,609,408 A * 3/1997 Targetti ..... 362/523
6,481,871 B2 * 11/2002 Jamison ..... 362/287
2007/0019418 A1 * 1/2007 Czech et al. ..... 362/364
2007/0103913 A1 * 5/2007 Lin ..... 362/362

* cited by examiner

*Primary Examiner*—Sandy O'Shea
*Assistant Examiner*—Evan Dzierzynski
(74) *Attorney, Agent, or Firm*—Troxell Law Office, PLLC

(57) ABSTRACT

An angle-adjustable recessed lamp structure comprises: a lamp bulb, a lamp holder, a rotatory carrier, and a mounting base. The rotatory carrier is securely screwed onto a track frame, which has a hollow sliding slot on the center of the arc-shaped body. The track frame is securely screwed on the fixing base via a fixing plate that locates on the rearward of the track frame. The fixing plate has two holding notches extending downward from both ends thereof for holding and positioning a rotation shaft. The rotation shaft is securely coupled with the coupling portion to enable the lamp holder to be rotatable by using pivotal connection between the rotatory carrier and the lamp holder. The lamp holder is upwards/downwards rotatable along the sliding slot within approximate 70 angles.

1 Claim, 6 Drawing Sheets

RECESSED LAMP STRUCTURE

FIELD OF THE INVENTION

The present invention relates to an angle-adjustable recessed lamp structure, and more particularly to a recessed lamp structure that is shiftable along the sliding slot within approximate 70 angles such that a lamp holder is smoothly rotatable and can be positioned at any position to avoid fall.

BACKGROUND OF THE INVENTION

As disclosed in U.S. Pat. No. 6,543,915, a lamp bulb is disposed inside a lamp holder. The lamp holder has two pivot rods bilaterally disposed at the bottom thereof and respectively positioned in two notches of a rotary carrier. Two upright rods are disposed adjacent to the notches, respectively. The upright rods are screwed onto a pressing plate such that the lamp holder can be pivotally connected to the rotary carrier for adjusting the lighting angle of the lamp bulb.

The pivot rods are bilaterally disposed on the outside bottom of the lamp holder so the notches must provide sufficient space for holding the pivot rods. As a result, the dimension of the recessed lamp structure is increased, and much more components are also required. Consequently, the integral efficiency is affected and the product cannot be minimized.

SUMMARY OF THE INVENTION

Whereas the aforesaid drawbacks, the present inventor discloses an improved structure with further promoted integral efficiency while considering the assembly cost and quality.

It is a main object of the present invention to provide an angle-adjustable recessed lamp structure that utilizes the space effectively by disposing a rotation shaft on the limited backside space of a lamp holder for connection with a rotatory carrier. The rotation shaft is fixed on the backside of the lamp holder and its both ends are held by a track frame. The lamp holder is pivotally coupled with the track frame via the rotation shaft. As a result, the lamp holder is pivotally coupled with the rotatory carrier to be rotatable within approximate 70 angles.

DETAILED DESCRIPTION OF THE PREFERRED EMBODIMENT

Figure 1:
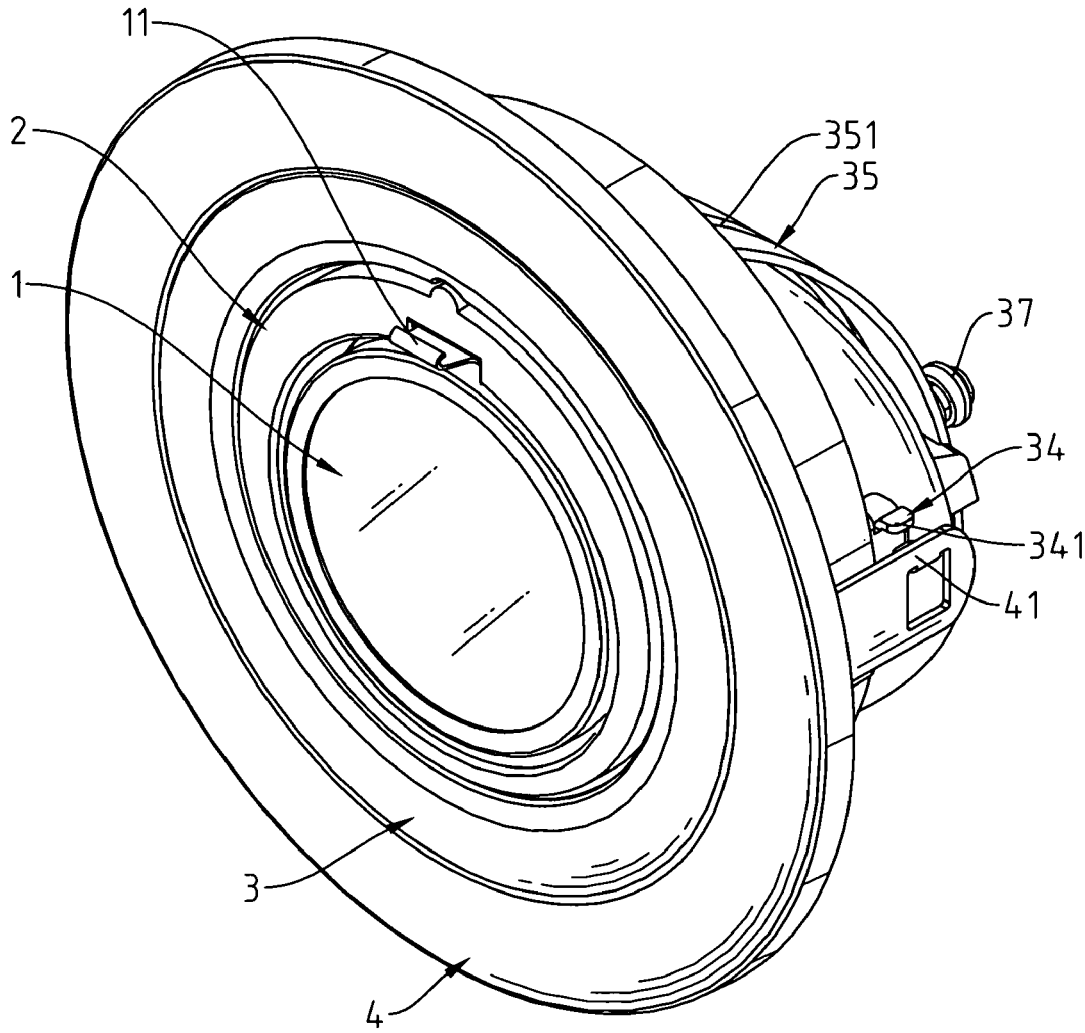
FIG. 1 is an elevational view of the present invention.
Figure 2:
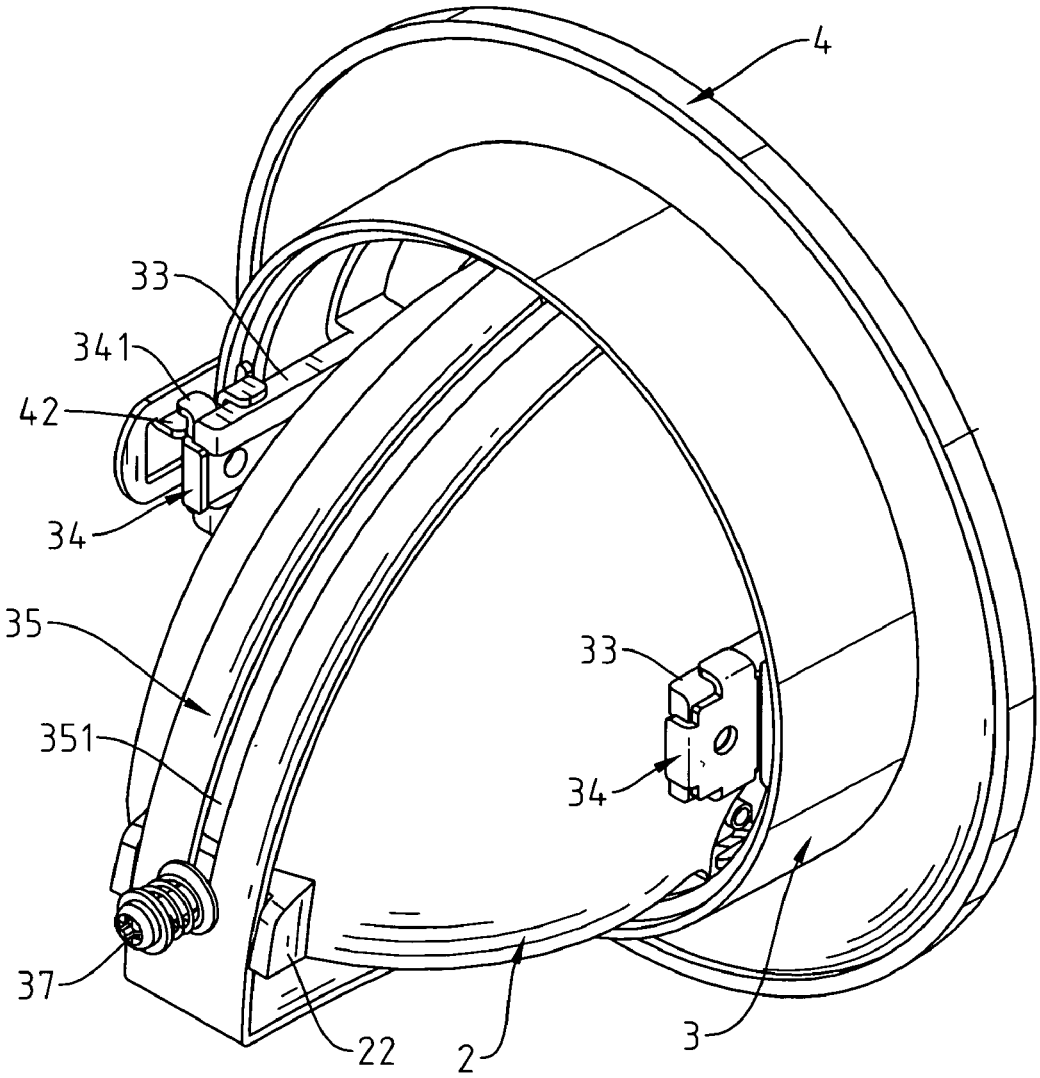
FIG. 2 is another elevational view of present invention taken from another direction.
Figure 3:
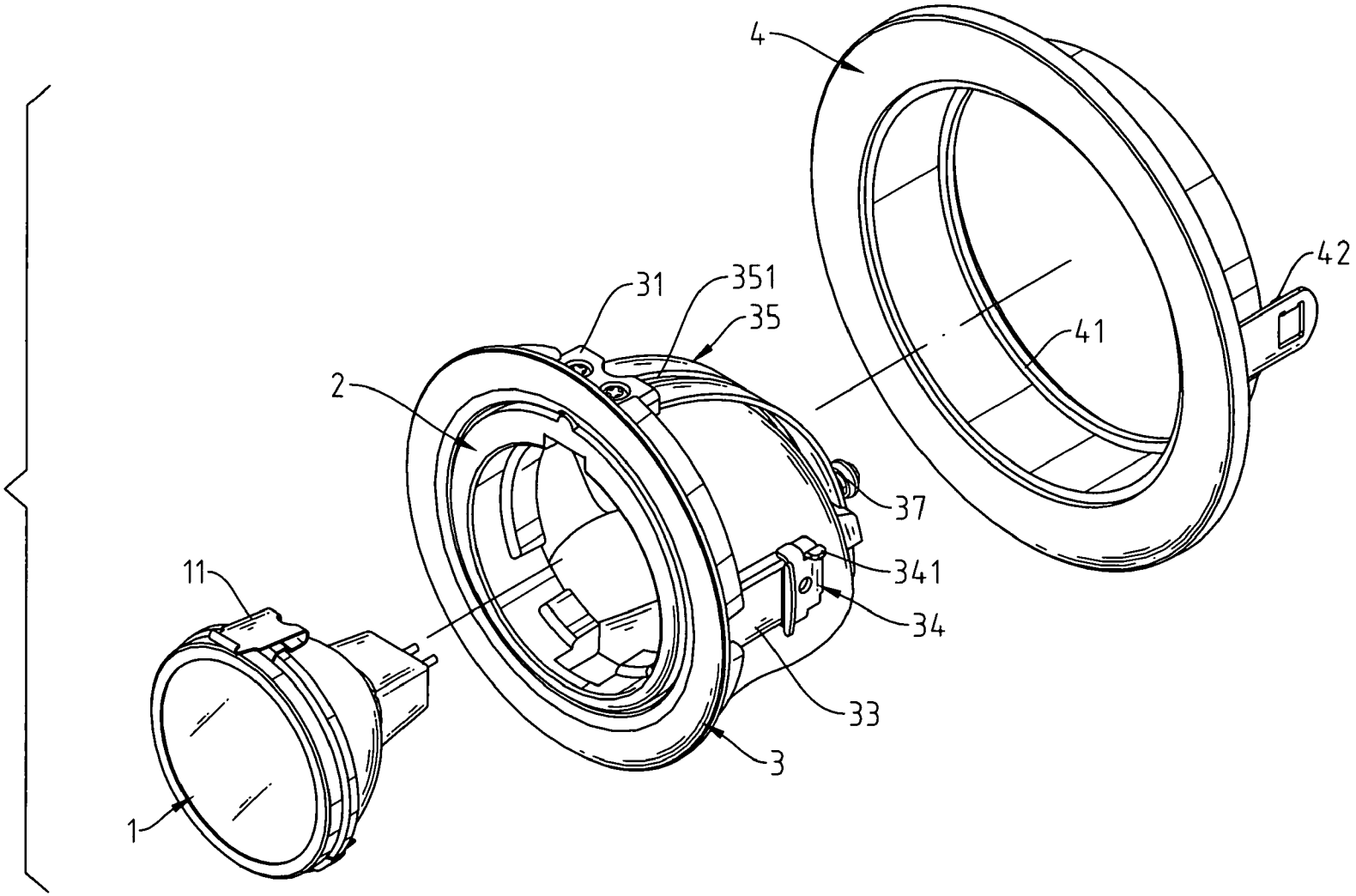
FIG. 3 is schematic, exploded view of the present invention.

Referring to FIG. 1 through FIG. 4, a recessed lamp structure of the present invention generally comprises a lamp bulb 1, a lamp holder 2, a rotatory carrier 3, and a mounting base 4. The lamp bulb 1 has elastic retaining plates

11. The lamp holder 2 has receiving trenches 21 on the annular inner wall for holding the elastic retaining plates 11 of the lamp bulb 1. In addition, the lamp holder 2 further has a runner base 22 and a coupling means 23 disposed oppositely on upper and lower location of an opening that forms on the rear of the lamp holder 2. The lamp holder 2 is rotatable between the rotatory carrier 3 and the mounting base 4 by coupling with the rotatory carrier 3.

The lamp holder 2 is pivotally disposed in the rotatory carrier 3 for adjusting the lighting angle. The rotatory carrier 3 has a coupling base 31 and a fixing base 32 disposed oppositely on the backside of the rim thereof. Two paired lateral arms 33 are disposed bilaterally on the rotatory carrier 3. Two insertion means 34 are fixed on the top portions of the lateral arms 33, respectively. A retaining plate 341 is protrudent from one of the insertion means 34. The coupling base 31 and fixing base 32 that locate on the backside of the rotatory carrier 3 are for holding a track frame 35.

The track frame 35 is bended about 90 degrees. A sliding slot 351 is formed on the upper portion of the track frame 35, and the front end of the track frame 35 is fixed on the coupling base 31 of the rotatory carrier 3. The track frame 35 is securely screwed on the fixing base 32 via a fixing plate 352 that locates on the rearward of the track frame 35. The fixing plate 352 has two holding notches 353 extending downward from both ends for holding and positioning a rotation shaft 36. The rotation shaft 36 is securely coupled with the coupling portion 23 via a screwing plate 361, and held by the holding notches 353 such that the lamp holder 2 is pivotally, rotatably connected with the rotation shaft 36.

The mounting base 4 is sleeved on the outside of the rotatory carrier 3 to enable the rotatory carrier 3 to lean on a flange 41 located on the inner edge of the mounting base 4 such that the rotatory carrier 3 is 360 degrees rotatable by using the insertion means 34 of the lateral arms 33 of the rotatory carrier 3.

Figure 4:
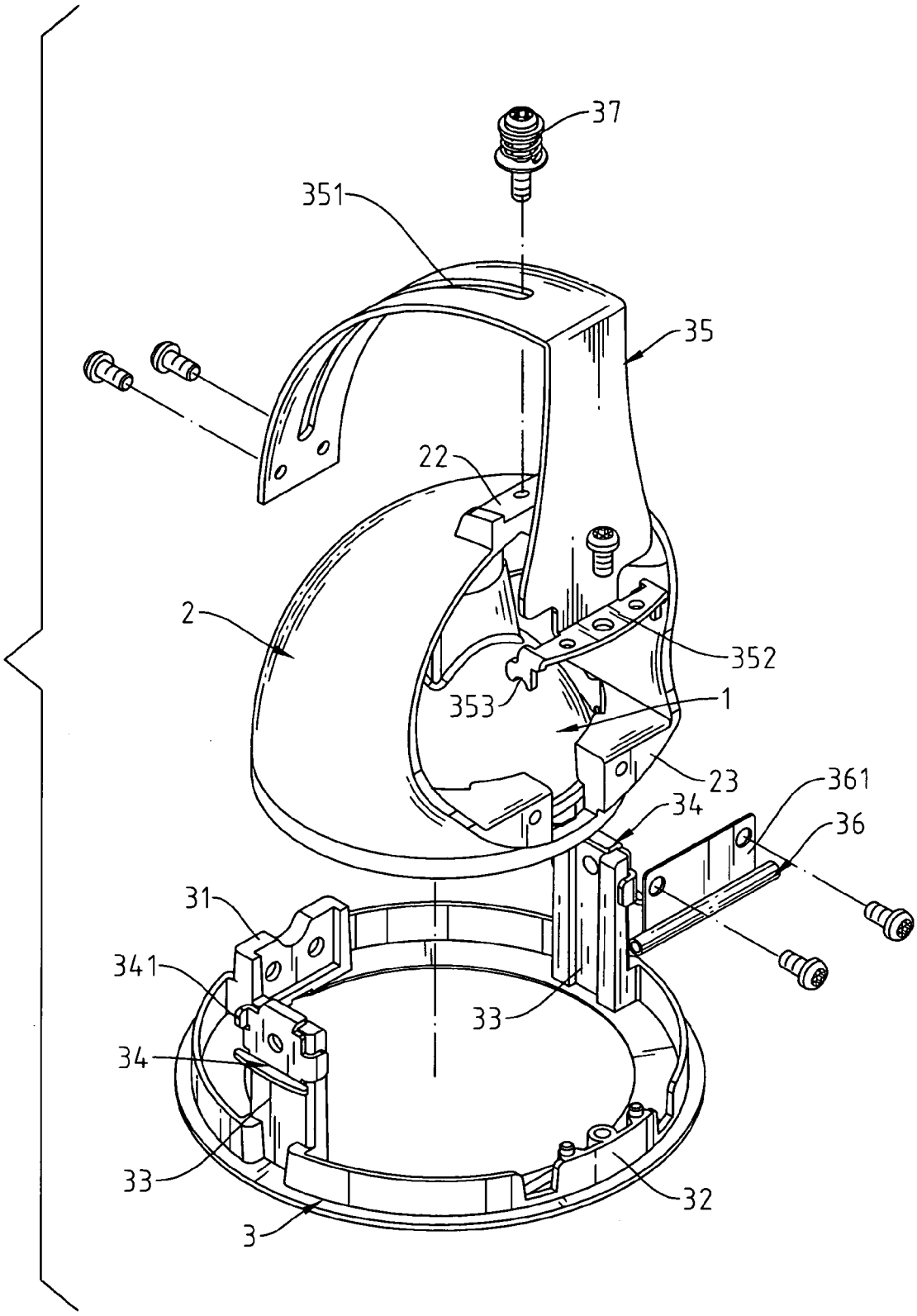
FIG. 4 is an elevational, exploded view showing angle-changing action of the present invention.
Figure 5:
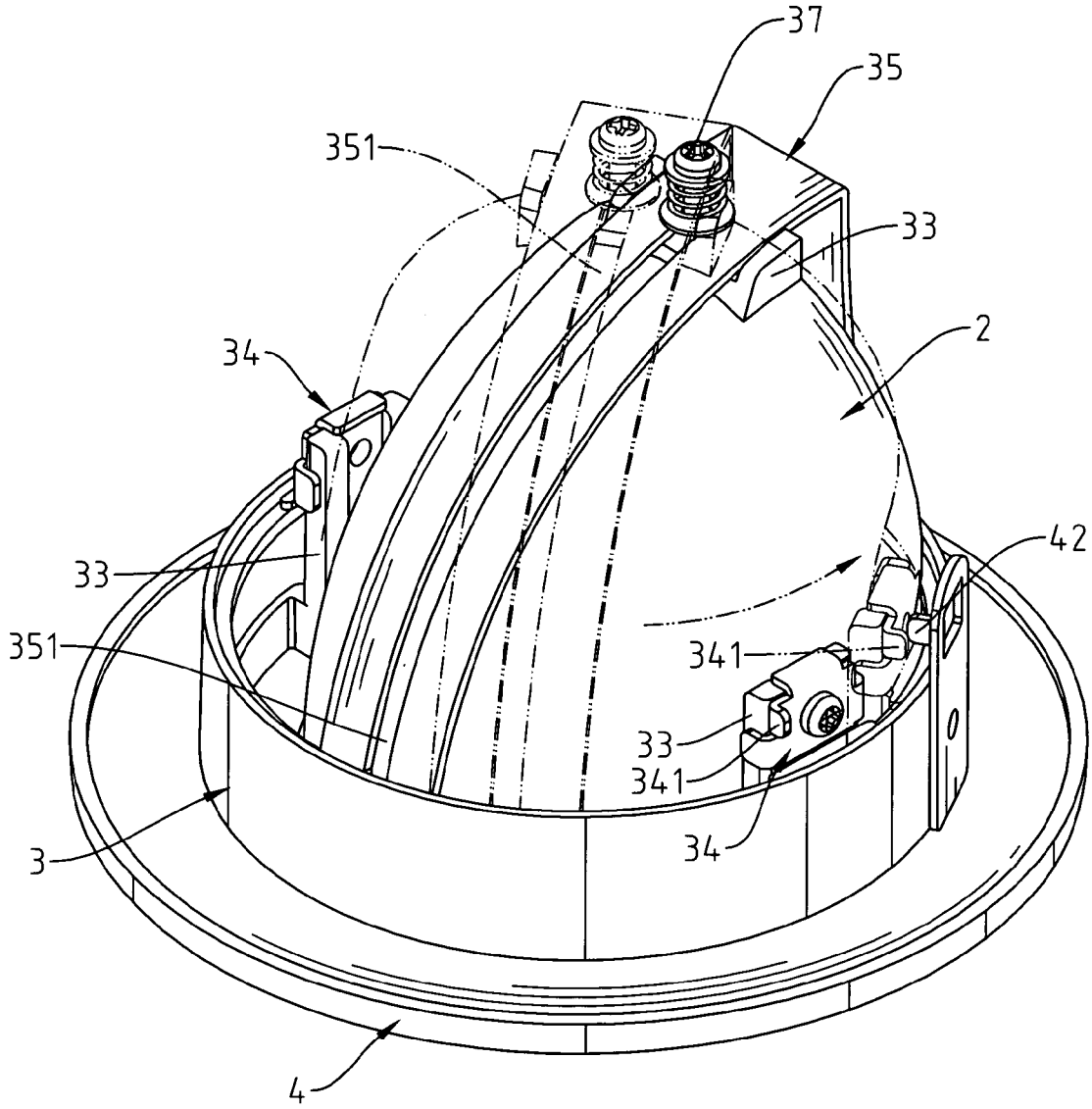
FIG. 5 is an elevational view showing circularly angle-changing action of the present invention.

Referring further to FIG. 4 and FIG. 5, two paired retaining plate 42 are securely riveted on the upper edge of the mounting base 4. As a result, in the assembly process, the rotatory carrier 3 can be directly disposed on the flange 41 of the mounting base 4 for rotation such that the retaining plate 341, which is protrudent from one of the insertion means 34, can be retained by slightly leaning against the retaining plate 42 for limit control. Accordingly, the rotatory carrier 3 is accurately, completely, flatly fastened and positioned on the mounting base 4 and is rotatable without the risk of fall.

Figure 6:
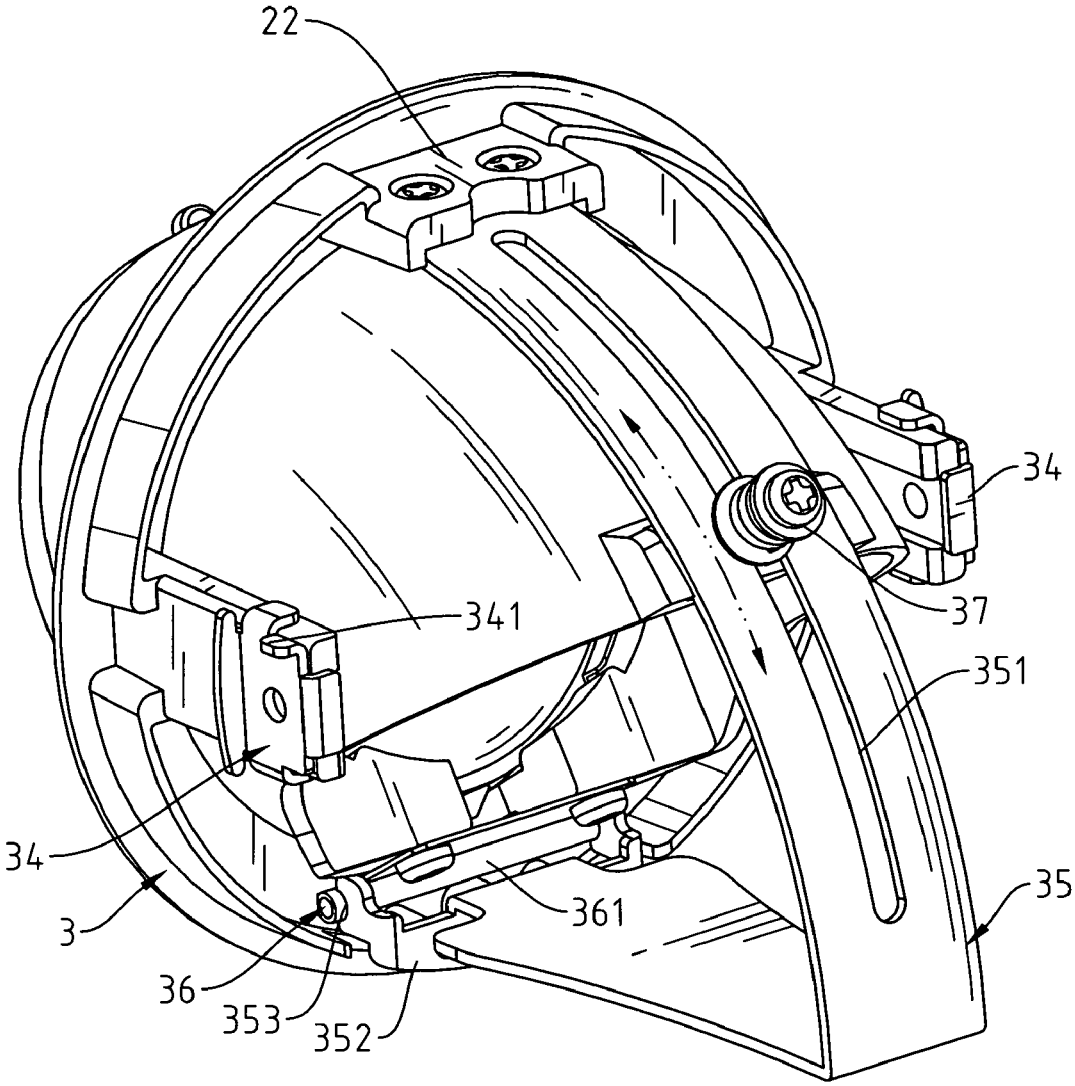
FIG. 6 is an elevational view showing longitudinally angle-changing action of the present invention.

Referring continuously to FIG. 4 and FIG. 6, the track frame 35 is processed to have an integrally extended arc-shaped body on the top. In addition, the track frame 35 has the hollow sliding slot 351 on the center of the arc-shaped body. An elastic screwing device 37 can be inserted through the hollow sliding slot 351 for screwing into the runner base 22 of the lamp holder 2. In this track frame 35, the elastic screwing device 37 is coupled with the runner base 22 by inserting through the arc-shaped body of the lamp holder 2 such that the lamp holder 2 is longitudinally rotatable along the sliding slot 351 within approximate 70 angles. Besides, the lamp holder 2 can be positioned on the sliding slot 351 by adjusting the tightness between a screw and a spring gasket of the elastic screwing device 37. As a result, the lamp holder 2 is smoothly rotatable and can be positioned at any moment to avoid fall.

As described above, the track frame 35 is integrally formed, and it is further coupled with the rotation shaft 36 for rotation. As a result, it has simpler mold design and reduced production cost. In addition, in order to ensure the assembly quality, the rotation shaft 36 is utilized to prevent the conventional complex structure. As a result, the components of the recessed lamp structure are light and handy, and it is easier to assembly the recessed lamp structure. Consequently, the required assembly time and the production cost are both reduced, and the production capability and the market competitiveness are both improved.

What the invention claimed is:

1. An angle-adjustable recessed lamp structure comprising: a lamp bulb, a lamp holder, a rotatory carrier, and a mounting base, wherein the lamp bulb is located inside the lamp holder, which is pivotally coupled with the rotatory carrier, to be longitudinally rotatable within approximate 70 angles and the mounting base is sleeved on the outside of the rotatory carrier such that the rotatory carrier is 360 degrees rotatable by leaning a pair of lateral arms of the rotatory carrier on an inner edge of the mounting base, wherein the rotatory carrier comprises: a coupling base and a fixing base disposed oppositely on a rim thereof; a pair of bilaterally disposed lateral arms; two insertion means fixed on respective top portions of the lateral arms; a retaining plate protrudent from one of the insertion means; a track frame fixed on the coupling base of the rotatory carrier via a front end thereof for being held by the coupling base and the fixing base; a sliding slot formed on an upper portion of the track frame; a rotation shaft securely coupled with a coupling portion of the lamp holder; and a fixing plate located on rearward of the track frame for being securely screwed onto the fixing base and having two holding notches extending downward from both ends thereof for holding and positioning the rotation shaft, wherein the lamp holder is pivotally coupled with the rotatory carrier via the rotation shaft such that the lamp holder is longitudinally rotatable within approximate angles.

* * * * *